US007131371B1

(12) United States Patent
Shober et al.

(10) Patent No.: US 7,131,371 B1
(45) Date of Patent: Nov. 7, 2006

(54) ELECTRONICALLY ACTUATED PRESS

(76) Inventors: Joseph Raymond Shober, 320 Bates St., Phillipsburg, NJ (US) 08865; Anthony M. Reduzzi, 595 S. 6th St., Bangor, PA (US) 18013; Michael Shober, 1965 C Cabernet Pl., Easton, PA (US) 18045; Michael A. Ciolino, 425 Kinderkamack Rd., West Wood, NJ (US) 07675; John Thomas Shober, Jr., 213 Nazareth Pike, Bethlehem, PA (US) 18020; Timothy Nelson Shober, 203 Nazareth Pike, Bethlehem, PA (US) 18020

( * ) Notice: Subject to any disclaimer, the term of this patent is extended or adjusted under 35 U.S.C. 154(b) by 0 days.

(21) Appl. No.: 11/204,429

(22) Filed: Aug. 16, 2005

(51) Int. Cl.
*B30B 9/04* (2006.01)

(52) U.S. Cl. ..... 100/126; 100/49; 100/135; 100/230; 100/289

(58) Field of Classification Search ..... 100/100, 100/104, 50, 107, 110, 113, 116, 48, 125, 100/49, 126, 127, 128, 130, 131, 132, 133, 100/134, 135, 214, 226, 227, 229 A, 230, 100/240, 229 R, 289, 295; 99/277, 277.1, 99/349; 210/224, 225, 231, 498
See application file for complete search history.

(56) References Cited

U.S. PATENT DOCUMENTS

| | | | | | |
|---|---|---|---|---|---|
| 9,382 | A | * | 11/1852 | Chadwick | 100/230 |
| 1,354,446 | A | * | 9/1920 | Deininger | 100/230 |
| 1,412,029 | A | | 4/1922 | Galdi | |
| 1,468,047 | A | | 9/1923 | Szafka | |
| 1,803,595 | A | * | 5/1931 | Catoldo | 100/107 |
| 1,919,815 | A | | 7/1933 | Villano | |
| 2,236,916 | A | | 4/1941 | Polk | |
| 2,295,922 | A | | 9/1942 | Weston | |
| 2,552,171 | A | | 5/1951 | Hagerty | |
| 2,572,286 | A | | 10/1951 | Smith | |
| 2,629,317 | A | | 2/1953 | Nelson | |
| 3,635,145 | A | | 1/1972 | Nardella | |
| 3,733,041 | A | | 5/1973 | Clavera | |
| 3,921,511 | A | * | 11/1975 | Gall | 100/107 |
| 4,429,626 | A | | 2/1984 | Ihara et al. | |
| 4,730,555 | A | | 3/1988 | Blanchot | |
| 4,872,404 | A | | 10/1989 | Quetsch et al. | |

(Continued)

OTHER PUBLICATIONS 4 pages from web site: www.winegrapepress.com, Copyright 2004.

*Primary Examiner*—Lowell A. Larson
*Assistant Examiner*—Jimmy Nguyen
(74) *Attorney, Agent, or Firm*—Caesar, Rivise, Bernstein, Cohen & Pokotilow, Ltd.

(57) ABSTRACT

A press for extracting fruit juice. The press includes a reservoir having a base and a reservoir wall extending from the base, the base having a fruit-contacting side, a non-fruit-contacting side and an opening. The press further includes a tank having a first opened end, a second opened end and a sidewall disposed therebetween, wherein the sidewall has a plurality of openings and the tank is seated on the fruit-contacting side of the base. Additionally, the press includes an actuator module positioned on the non-fruit-contacting side of the reservoir base. The actuator module has a motor and a press shaft. The press shaft is disposed through the opening of the reservoir base. The motor is drivingly connected to the press shaft to move it between retracted and extended positions. A press plate is detachably secured to the press shaft.

13 Claims, 5 Drawing Sheets

U.S. PATENT DOCUMENTS

| | | | |
|---|---|---|---|
| 5,031,524 | A | 7/1991 | Wettlaufer |
| 5,035,174 | A | 7/1991 | Seal, Jr. |
| 5,081,921 | A | 1/1992 | Gregoire |
| 5,355,785 | A | 10/1994 | Pera et al. |
| 5,365,838 | A | 11/1994 | Valentini |
| 5,377,584 | A | 1/1995 | Egretier |
| 5,613,430 | A | 3/1997 | Lee |
| 5,628,247 | A | 5/1997 | Palumbo et al. |
| 2003/0150331 | A1 | 8/2003 | Massat |
| 2003/0154867 | A1 | 8/2003 | Kim |
| 2004/0076712 | A1 | 4/2004 | Rogers et al. |
| 2004/0076713 | A1 | 4/2004 | Lorincz |
| 2004/0187710 | A1 | 9/2004 | Arch et al. |
| 2004/0194645 | A1 | 10/2004 | Krammer |

* cited by examiner 114
112
113
111
101
110
108a
106
109a
105
107
108b
103
109b
104
102
102

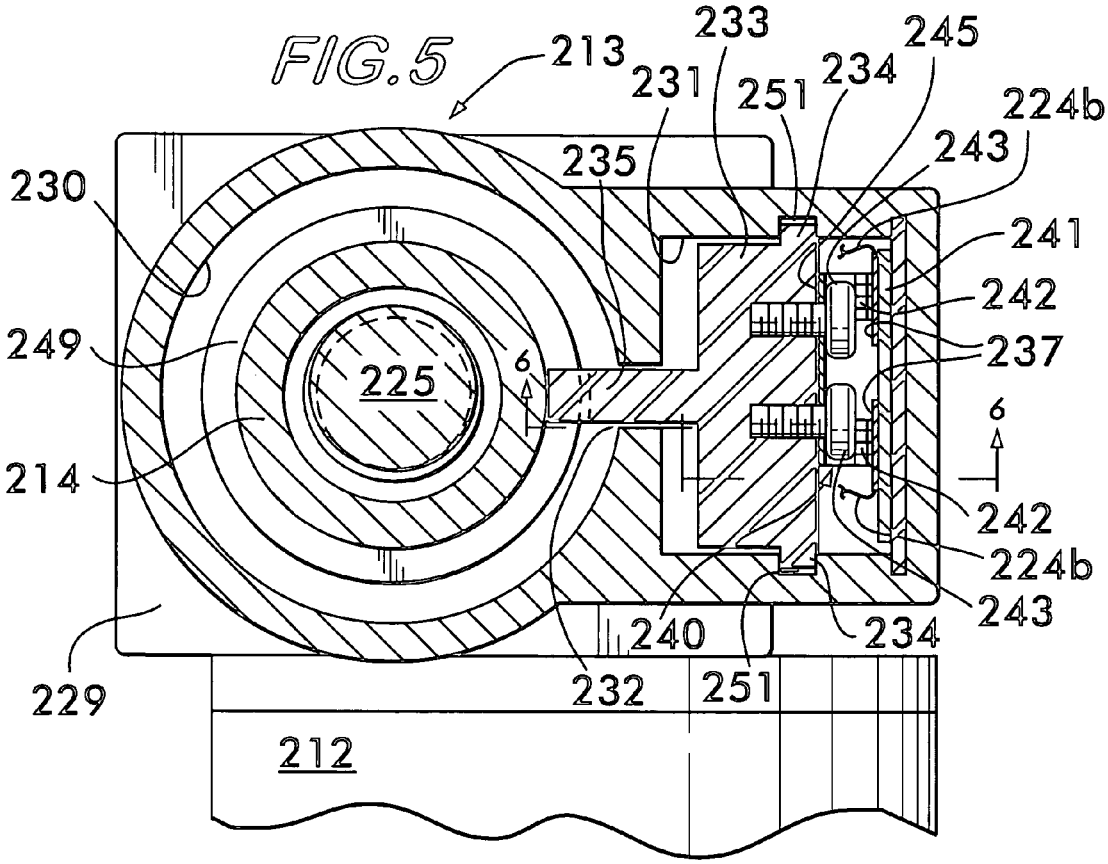
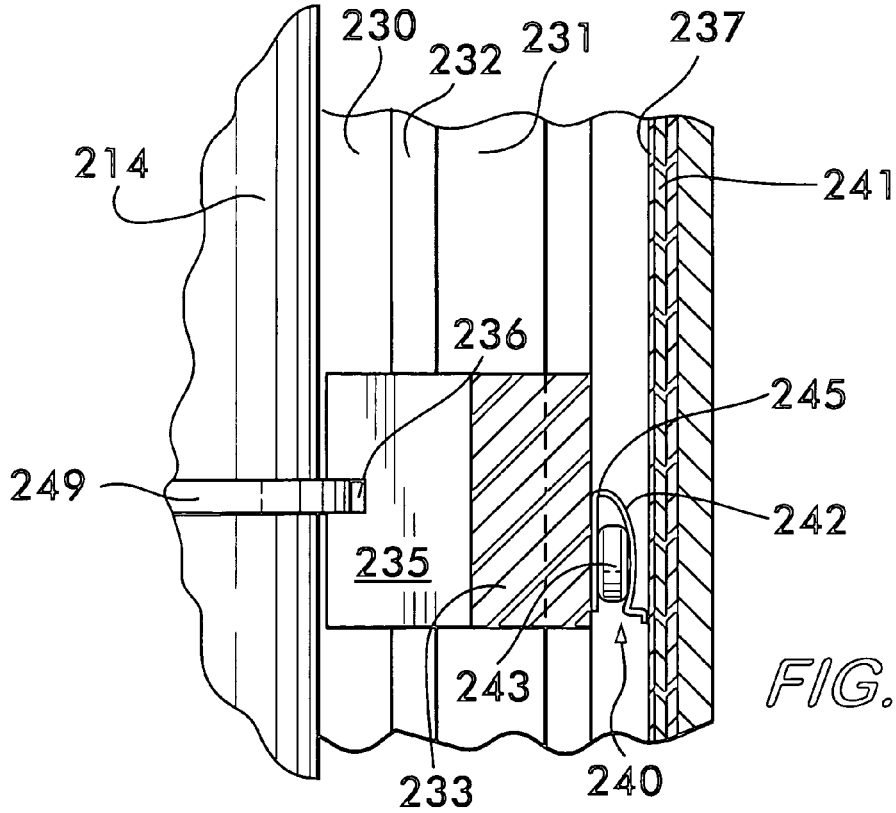
FIG.6

ELECTRONICALLY ACTUATED PRESS

FIELD OF THE INVENTION

The present invention relates in general to fruit presses, and more particularly to an electronically actuated press, that is capable of pressing any type of fruit and is especially suited for pressing grapes.

BACKGROUND OF THE INVENTION

A prior art mechanical wine press 101 shown in FIG. 1. The prior art wine press 101 has legs 102 supporting a reservoir 103 and a tank 105. The tank 105 is comprised of a plurality of vertical slats 106 which are retained in their respective fixed positions by an upper retaining ring 108*a* and a lower retaining ring 108*b*. The two retaining rings 108*a,b* have ring latches 109*a,b*, which when released, permit a user to open the tank 105 for emptying pressed grape skins, and when locked, retain the tank 105 in a closed position. The plurality of vertical slats 106 of the tank 105 are spaced apart from one another, creating a corresponding plurality of tank openings 107 for juice from pressed grape skins to run through.

A threaded rod 112 is aligned vertically through the central axis of the tank 105. The threaded rod 112 extends through a central opening in a press plate 110. Shown also are a plurality of removable blocks 111 disposed on top of the press plate 110. A ratchet assembly 113 engages the threads on the threaded rod 112, the ratchet assembly having a handle 114.

Prior to use of the prior art wine press 101, wine grapes are placed in a device for crushing and destemming grapes (not shown). The crushed grape skins and juice released therefrom are then contained in a barrel (not shown). The juice along with the stemless crushed grape skins may be fermented in the barrel as in the case of red wine grapes. In the case of white wine grapes, one may choose to not ferment them. Next, the ratchet assembly 113, blocks 111 and press plate 110 are removed from the threaded rod 112 of the wine press 101 and the stemless crushed grape skins and juice are placed into the tank 105 using a scoop (not shown). Free juice runs through the openings 107 located between the spaced-apart vertical slats 106 and into the reservoir 103. The tank 105 is filled substantially to the top with the crushed grape skins and the juice. The press plate 110 and rachet assembly 113 are placed over the threaded rod 112 and a first set of blocks 111 is placed therebetween.

The handle 114 of the ratchet assembly 113 is cranked slowly in a clockwise direction, thereby driving the press plate 110 gradually downwardly to press the crushed grape skins slowly to squeeze additional juice from the skins which flows through the plurality of tank openings 107 and into the reservoir 103. Once the press plate 110 has been driven to its most downward position, the handle 114 of the ratchet assembly 113 is rotated counter-clockwise so it can be removed and a second set of blocks 111 can be placed between the press plate 110 and the ratchet assembly 113. As shown in FIG. 1, a second set of two blocks are placed on top of and at a right angle to a first set of two blocks for a total of four blocks. Due to the addition of the second set of blocks 111, on the second pressing, the press plate 110 can be driven a further distance within the tank 105 to impart additional pressure upon the crushed skins and squeeze additional juice therefrom which flows through the plurality of tank openings 107 and into the reservoir 103. The reservoir is provided with a spout 104 to enable juice to run into a suitable collection basin (not shown) when the reservoir 103 becomes filled. Additional sets of blocks 111 may be added to the first and second sets of blocks 111 for successive pressings to obtain additional juice from the crushed skins. The process of adding blocks 111 in successive pressings is repeated until all of the juice has been extracted from the crushed skins. The purpose for employing successive pressings rather than extracting juice in a single pressing is to avoid spraying of the juice during pressing to ensure that the reservoir 103 collects all of the juice and none goes to waste.

When all juice has been extracted, what remains within the tank 105 is a highly compressed solid mass of pressed grape skins which is almost dry and occupies approximately the lower half of the tank 105 and resembles a wheel when removed from the tank 105. The handle 114 of the ratchet assembly 113 is rotated counter-clockwise returning the press plate 110 and blocks 111 to their initial position for removal and cleaning. The ring latches 109*a* and 109*b* may be released to open the tank 105 for gaining access to and removing the highly compressed solid mass of grape skins. Alternatively, after one or several successive pressings, additional crushed grapes may be added within the tank 105 which reduces the need for adding blocks 111.

A mechanical wine press such as the prior art one depicted in FIG. 1 is lacking in several respects. First, the mechanical nature of the wine press 101 shown in FIG. 1 requires physical exertion in the form of cranking the handle 114 of the ratchet assembly 113 in order to press the crushed grapes. Also, the user needs to crank the handle 114 in the reverse direction to return the ratchet assembly 113 to its initial position. When done repeatedly, this process can require significant time and effort. Second, as explained supra, the prior art wine press 101 employs the use of blocks 111 to enable the press plate 110 to be driven a further distance into the tank 105 to impart additional pressure and squeeze additional juice from the crushed grapes skins. Adding and removing blocks 111 is time consuming and adds complexity to the pressing process. Thirdly, applying and removing the ratchet assembly 113 adds unnecessary time and increases the complexity of the pressing process.

The wine press of the present invention overcomes these disadvantages and significantly improves speed, efficiency and ease of wine pressing over prior art presses such as that shown in FIG. 1.

SUMMARY OF THE INVENTION

In accordance with the present invention, a press for extracting juice from fruit is disclosed.

The press includes a reservoir having a base and a reservoir wall extending from the base, the base having a fruit-contacting side, a non-fruit-contacting side and an opening. A tank is seated on the fruit-contacting side of the base. The tank has a first opened end, a second opened end and a sidewall which is disposed therebetween. The sidewall has a plurality of openings. An actuator module is positioned on the non-fruit-contacting side of the reservoir base, the actuator module comprising a motor and a press shaft. The press shaft is disposed through the opening of the reservoir base. The motor is drivingly connected to the press shaft to move the press shaft between retracted and extended positions. Furthermore, a press plate is detachably secured to the press shaft.

BRIEF DESCRIPTION OF THE DRAWINGS

For a more complete understanding of the present invention, and the advantages thereof, reference is now made to the following description taken in conjunction with the accompanying drawings, in which:

FIG. 5 is an enlarged sectional view taken along line 5—5 of FIG. 4.

FIG. 6 is an enlarged sectional view taken along line 6—6 of FIG. 5.

DESCRIPTION OF THE PREFERRED EMBODIMENTS

The principles of the present invention and their advantages are best understood by referring to the illustrated embodiment depicted in FIGS. 1–6 of the drawings, in which like numbers designate like parts.

Figure 1:
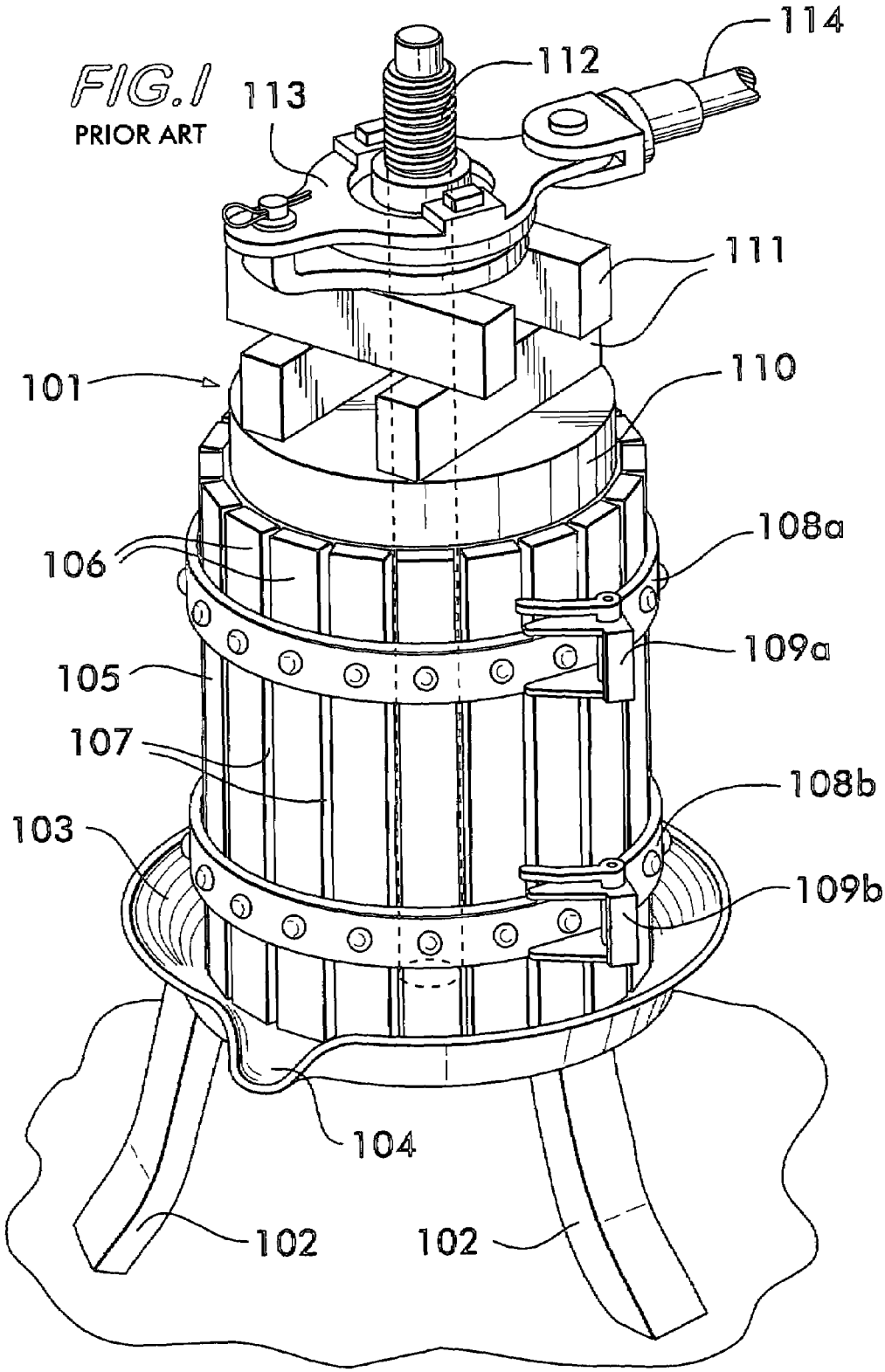
FIG. 1 PRIOR ART
FIG. 1 is a prior art wine press.
Figure 2:
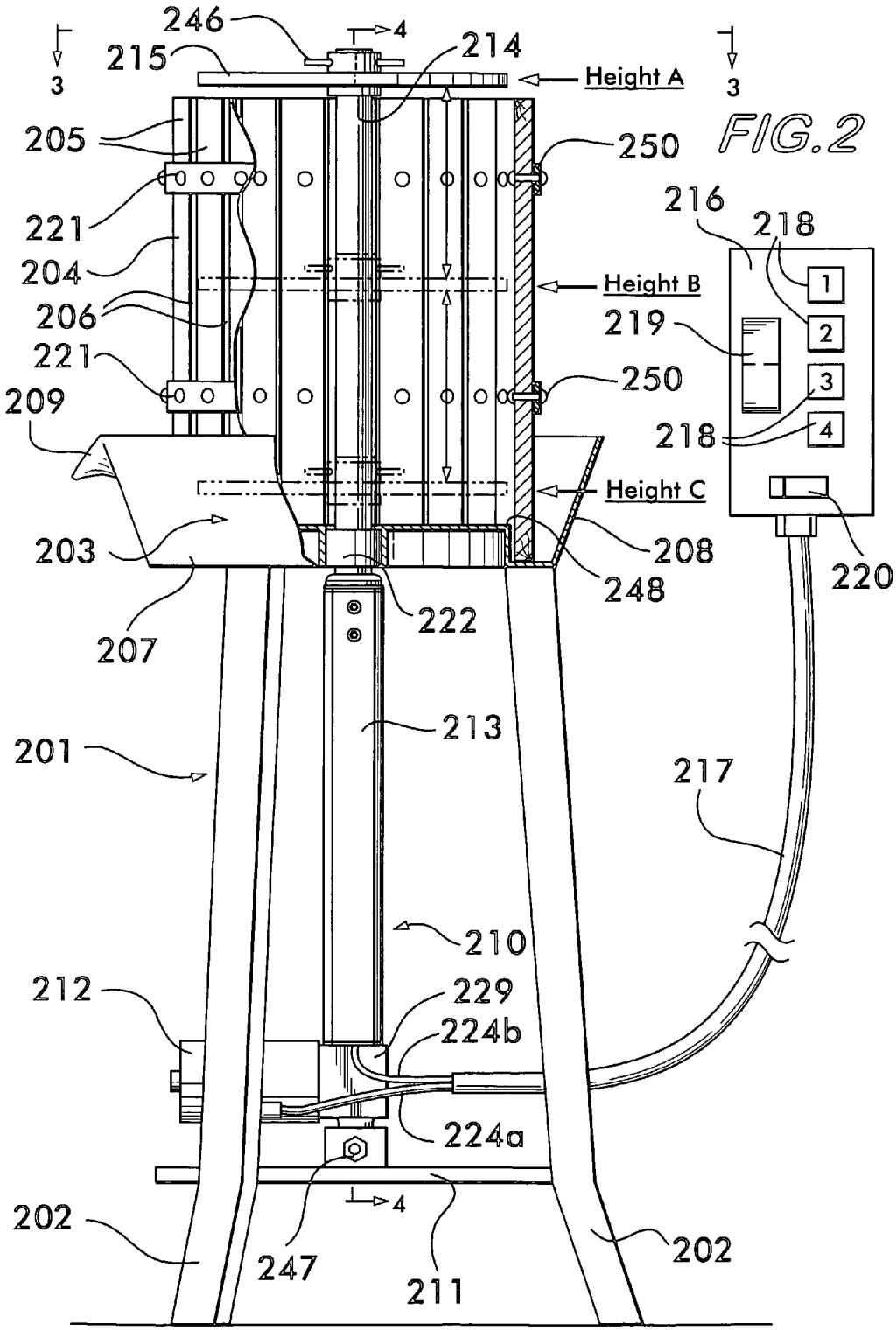
FIG. 2 is a partial sectional view of a wine press of the present invention.
Figure 3:
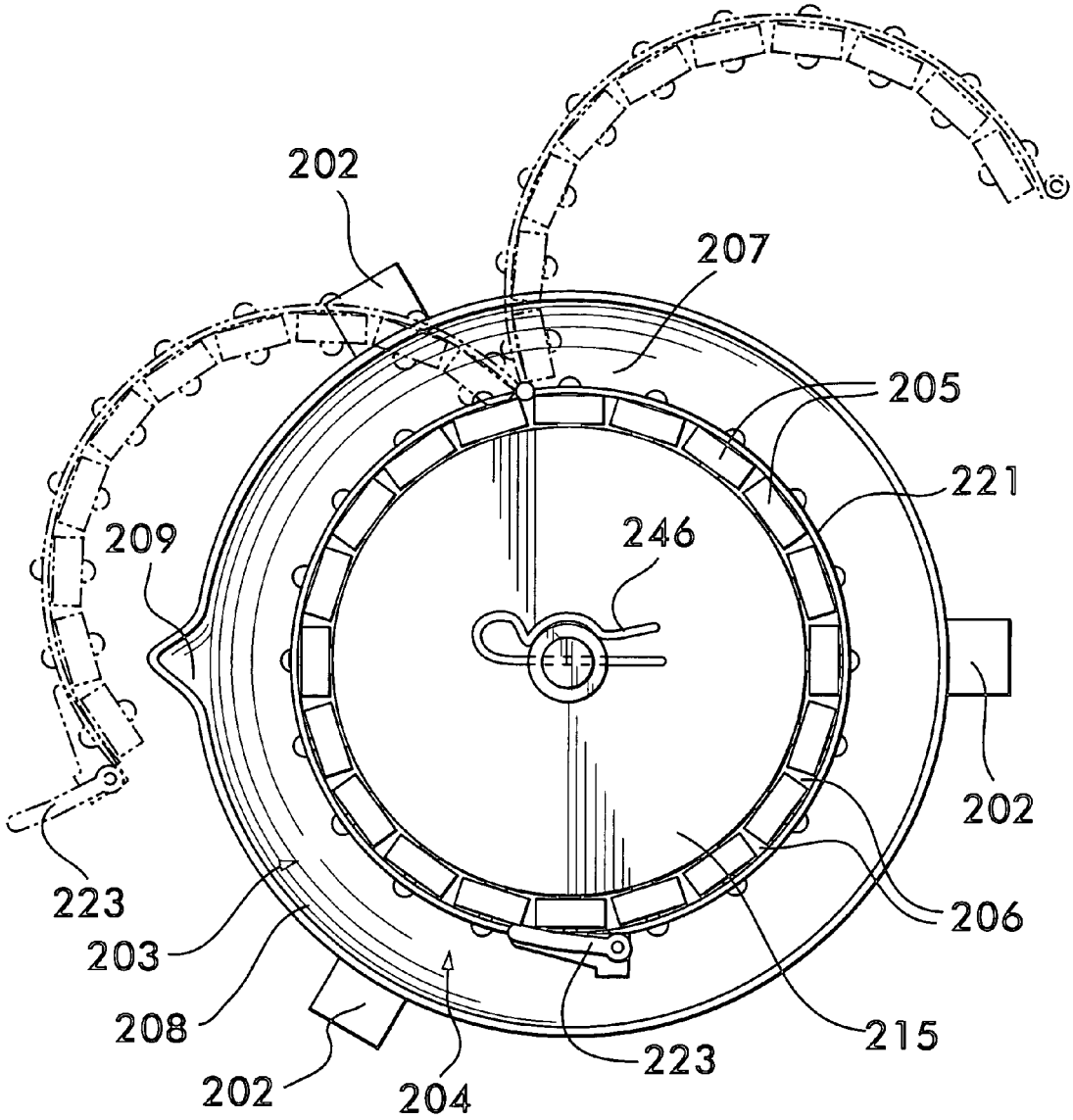
FIG. 3 is a top view of the wine press of the present invention, depicting the tank of the same in closed and opened positions, respectively.

Referring to FIG. 2, there is shown a partially sectioned view of a wine press 201 of the present invention. Like the prior art press 101 shown in FIG. 1, the wine press 201 of the present invention shown in FIG. 2 has legs 202 supporting a reservoir 203 and a tank 204. The tank 204 is comprised of a plurality of vertical slats 205 made of any suitable material, e.g., wood, which are retained in their respective fixed positions by retaining rings 221. The retaining rings 221 are affixed to the slats 205 by a suitable means, e.g., screws 250. The plurality of vertical slats 205 of the tank 204 are spaced apart from one another, creating a corresponding plurality of tank openings 206, through which extracted juice flows during pressing. As best shown in FIGS. 2 and 3, the reservoir 203 comprises a substantially flat and circular base portion 207 and a slanted reservoir wall portion 208 that is integral with the base portion 207 and extends upwardly at an angle from the base portion 207. A spout 209 is formed out of a small portion of the reservoir wall portion 208. The reservoir 203 serves to collect extracted juice that flows out of the tank openings 206. One may position a suitable collection basin (not shown) beneath the spout 209, so that when the reservoir 203 becomes filled with juice, the juice would flow therefrom by means of the spout 209, into the collection basin.

Figure 4:
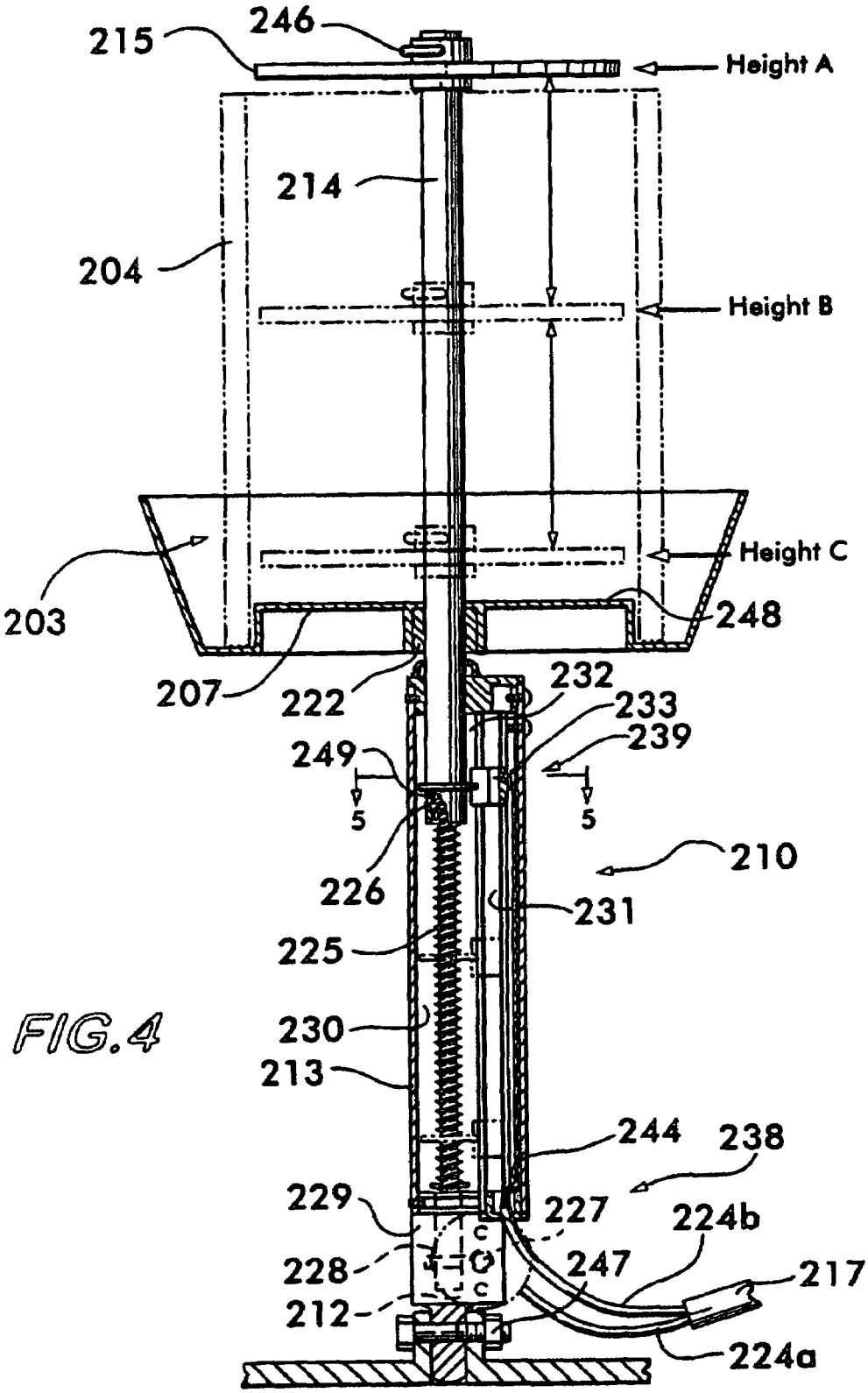
FIG. 4 is a sectional view taken along line 4—4 of FIG. 2.

The wine press 201 additionally comprises an actuator module 210 which is affixed to an actuator platform 211 located near the bottom of the wine press 201, using any suitable hardware, e.g., bolts 247. The actuator platform 211 is fixedly secured to the legs 202 by any suitable means such as welding. Referring now to FIG. 4, the actuator module 210 includes an electric motor 212, an actuator housing 213 and a press shaft 214 which extends through an opening located at the top end of the actuator housing. Referring now to FIG. 4, the circular base portion 207 of the reservoir 203 includes a central opening 222 which enables the press shaft 214 to be disposed therethrough. A press plate 215 is releasably secured onto the distal portion of the press shaft 214 by means of a removable pin 246 (FIGS. 2–4). As will be explained in detail below, the linear movement of the press shaft 214 between a retracted position and an extended position will control directional movement and the location of the press plate 215.

Referring again to FIG. 2, a control pad 216 is electronically connected to the actuator module 210 by means of an electric cable assembly 217. Featured on the control pad 216 are buttons 218, a directional switch 219 and a mode switch 220. The buttons 218 are designated with numbers "1," "2," "3" and "4." The buttons 218, directional switch 219 and mode switch 220 coact in known ways with a printed circuit board (not shown) located within the control pad 216 to generate suitable electrical signals in response to respective depression of numbered buttons 218 or positions of respective switches 219, 220. The buttons 218 each correspond to a respective pre-programed height of the press plate 215. As an example, and by no means limiting the disclosed embodiment, three different press plate heights are depicted in FIGS. 2 and 4: "Height A," which is the top-most press plate 215 position, "Height B," which is an intermediate press plate 215 position and "Height C," which is a lower press plate 215 position. A user may, for example, program the button 218 designated as 1 to correspond to Height C, the button 218 designated as 2 to correspond to Height B and the button 218 designated as 3 to correspond to Height A. The manner in which these buttons 218 are programmed is explained below. The user would depress the directional switch 219 to move the press plate 215 in either an upward or downward direction. The directional switch 219 is a standard three-way rocker switch, having "up," "down" and "neutral" positions. Depressing the directional switch 219 to the "up" position causes the press plate 215 to travel upwardly. Likewise, depressing the directional switch 219 to the "down" position causes the press plate 215 to travel downwardly. The mode switch 220 on the control pad 216 is a three-position switch which enables a user to select between a "run mode," a "program mode" or an "off" position.

While in "program mode," the buttons 218 may be programmed in the manner set forth below. Once the buttons 218 are programmed in the manner set forth below, the user may switch the mode switch 220 to "run mode," and depress one of the buttons 218, to automatically move the press plate 215 to the position associated with that button 218. Alternatively, while in "run mode," the user may operate the wine press 201 by simply using the depressing directional switch 219 in the desired direction, i.e., down or up.

A top view of the wine press 201 of the present invention is shown in FIG. 3. The tank 204 is shown in a closed position, as represented by solid lines and in an opened position, as represented by broken lines. Seen also from this perspective is the top ring latch 223, which, like the bottom ring latch (not shown in this view) operates to secure the tank 204 in a closed position and permits a user to open the tank 204 in a manner similar to the ring latch 109 in the prior art wine press 101 of FIG. 1. This feature enables the user to easily open the tank 204 for removing pressed grape skins, adding grape skins to be pressed and for cleaning out any residue from the tank 204.

Referring now to FIG. 4, some of the internal parts of the actuator module 210 are shown. The primary purpose of the actuator module 210 is to pull the press plate 215 down against the grapes in order to extract juice therefrom. The actuator module 210 is essentially comprised of an electric motor 212, an actuator housing 213, a non-rotational press shaft 214 and an externally threaded actuator rod 225. The press shaft 214, which is hollow, is disposed over the externally threaded actuator rod 225. When actuated, the electric motor 212 causes the externally threaded actuator rod 225 to rotate, thereby linearly driving the press shaft 214, either up or down. The press plate 215 is secured to the press shaft 214 and the linear movement of the press shaft 214 from a fully extended position to a fully retracted position, displaces the press plate 215 from Height A through Height B and Height C and towards the surface 248 of the base portion 207 of the reservoir 203. In this manner, juice can be extracted from crushed grapes added to the tank 204 in a progressive manner so that it can be collected within the reservoir 203 with minimal spraying or loss of juice.

Referring now to FIG. 2, two leads 224*a,b* branch out from the electric cable assembly 217 which extends from the control pad 216 (see FIG. 2). One of those leads 224*a* provides electrical power to the electric motor 212. Referring now to FIG. 4, actuation of the electric motor 212 causes rotation of an output shaft 227 which includes a threaded free end (not shown) that acts as a worm wheel, the output shaft being located within a gear housing 229. Rotation of the output shaft 227 causes rotation of a worm gear 228 (FIG. 4), the worm gear 228 being either integral with, or connected to the externally threaded actuator rod 225. The interrelationship of the gears results in rotation of the externally threaded actuator rod 225, when the electric motor 212 is actuated. A ball element 226 is partially housed in the internal wall of the press shaft 214, which engages the threads of the externally threaded actuator rod 225. Thus, as the externally threaded actuator rod 225 rotates, the ball element 226 follows the helical contours of the screw threads, thereby causing linear movement of the press shaft 214 in upward and downward directions.

One alternative design of the actuator module 210 (not shown) would include omission of the ball element 226 from the press shaft 214. The internal wall of the press shaft 214 would be threaded and the press shaft 214 would be disposed over the externally threaded actuator rod 225 and in threaded engagement therewith. Thus, as the externally threaded actuator rod 225 rotates, it would cause the press shaft 214 to move in a linear direction.

Referring now to FIGS. 4–6, substantially the entire length of the externally threaded actuator rod 225 extends within a cylindrical portion 230 of the actuator housing 213. The actuator housing 213 also comprises a generally rectangular portion 231 which is in communication with the cylindrical portion 230 by means of a slot 232 (FIG. 5) that extends the length of the actuator housing 213. Also disposed within the cylindrical portion 230 is the press shaft 214 which, as best shown in FIG. 4, is disposed over the externally threaded actuator rod 225.

As best shown in FIGS. 5 and 6, a slidable element 233 is disposed within the generally rectangular portion 231 of the actuator housing 213. The slidable element 233 includes a pair of horizontally extending flanges 234, each flange being disposed within a slot 251 located on each side wall of the generally rectangular portion 231 of the actuator housing 213. In this manner, the slots 251 together form a track in which the slidable element 233 may freely travel by sliding back and forth over the entire length of the generally rectangular portion 231 of the actuator housing 213. The slidable element 233 also includes a flange 235 which extends through the slot 232 in the actuator housing 213. As shown in FIG. 6, the flange 235 is provided with a slot 236 in which an upstanding collar 249 of the press shaft 214 is seated. In this manner, the slidable element will travel up and down with the press shaft 214. The upstanding collar 249 is located at the proximal end of the press shaft 214, and may either be integral with, or connected to the press shaft 214.

Extension of the flange 235 through the slot 232 and its connection to the press shaft 214 prevents rotational movement of the press shaft 214 during operation of the press 201. In this manner, rotational movement of the externally threaded actuator rod 225 causes the press shaft 214 to travel linearly within the actuator housing 213 from the fully retracted position wherein substantially the entire length of the press shaft 214 is disposed within the actuator housing 213 to the fully extended position wherein a major portion of the press shaft 214 extends outside of the actuator housing 213 and into the tank 204.

Referring to FIGS. 4–6, the actuator module 210 includes a variable resistance circuit assembly housed within the generally rectangular portion 231 of the actuator housing 213. The variable resistance circuit assembly functions to measure resistance over the circuit, which changes based upon the position of the press shaft 214 and press plate 215 within the tank 204. In this manner, buttons 218 on the control pad 216 can be programmed to control upward and downward movement of the press plate 215 to predetermined heights such as Height A, Height B and Height C shown in FIGS. 2 and 4. The assembly includes a pair of conductive strips 237 disposed on the side wall of the generally rectangular portion 231 of the actuator housing. The conductive strips 237 are straight and substantially parallel and therefore are electrically isolated from one another. As best shown in FIG. 4, the conductive strips 237 extend substantially the entire length of the actuator housing 213 and include a bottom end 238 and a top end 239. The conductive strips 237 may be formed of any suitable electrically conductive material, e.g., copper, and are attached to a non-conductive base strip 241 which is in turn attached to the side wall of the generally rectangular portion 231. Referring again to FIGS. 5 and 6, a bridge assembly 240 mounted to the slidable element 233 serves as an electrical bridge between the conductive strips 237 thus bringing them into electrical contact. The bridge assembly 240 includes a pair of electrically conductive brushes 242 that are secured to the slidable element 233 by any suitable means, e.g., bolts 243. Importantly, the conductive brushes 242 are electrically connected by virtue of a conductive element 245 (FIG. 5) extending therebetween that is integral with the conductive brushes 242. Each conductive brush 242 is in electrical contact with one of the conductive strips 237. The bridge assembly 240 is arranged for movement along the entire length of the conductive strips 237 with the conductive brushes 242 remaining in electrical contact with the conductive strips 237 at all times.

An electrical lead 224*b* is divided into two subleads and attached at respective lower ends of the conductive strips 237 (FIG. 5) at 244 (FIG. 4). The lead 224*b* extends into the electric cable assembly 217 and is thereby in electrical connection with the control pad 216 (see FIG. 2) in which a potentiometer (not shown) is disposed. The potentiometer is provided to measure electrical resistance over a predetermined range. In particular, the potentiometer measures resistance over a portion of the conductive strips 237 between the bottom end 238 (FIG. 4) and the bridge created by the bridge assembly 240 (FIGS. 5 & 6). Since the bridge assembly 240 is capable of movement along the entire length of the conductive strips 237, the resulting circuit varies in length as the bridge assembly 240 moves. As the bridge assembly 240 moves towards the top end 239 of the conductive strips 237, the length of the circuit increases and resistance measured over the length of the circuit by the potentiometer increases. As the bridge assembly 240 moves towards the bottom end 238 of the conductive strips, the length of the circuit decreases and resistance measured by the potentiometer decreases. Thus, the level of electrical resistance measured by the potentiometer corresponds to a position of the press shaft 214 and consequently the height of the press plate 215 within the tank 204 at any given instance.

Referring now to FIG. 2, the control pad 216 includes a central processing unit (CPU), preferably a programmable microprocessor (not shown) having software recorded therein. The CPU is mounted to the printed circuit board (not shown). The control pad 216 also includes other electronic components, e.g., capacitors, fail/safe relays, fuses, resistors, switches, diodes, etc., mounted to the printed circuit board and connected to the CPU through the circuit board.

The CPU is also provided with permanent or non-volatile memory that retains data stored therein even when power to the memory device is shut off, e.g., an EEPROM. The memory is used to store resistance values measured by the potentiometer (not shown). Thus, when the mode switch 220 is set to "program mode," the user may program each of the buttons 218 to be associated with a position of the press plate 215. Thus, for example, the button 218 designated as 1 can be associated with Height C, the numbered button 218 designated as 2 can be associated with Height B, and the button 218 designated as 3 can be associated with Height A. Consequently, during "run" mode, when the user depresses the button 218 designated as 1, the press plate 215 will automatically return to that predetermined height, e.g., Height C, unless and until the user reprograms that button 218 when in "program mode." The user may utilize the "program mode" for programming up to three additional preset press plate 215 positions.

In order to operate the wine press 201 of the present invention, see FIGS. 2–6, the user sets the mode switch 220 on "run mode" and depresses the directional switch 219 to the "up" position until the press plate 215 reaches its top-most position, immediately above the tank 204. The press plate 215 is then removed and an amount of stemless crushed grape skins and juice are placed into the tank 105 using a scoop (not shown) as described in the prior art. Free juice runs through the openings 206 located between the vertical slats 205 and into the reservoir 203. The tank 204 is filled substantially to the top with the crushed grape skins and the juice. Next, the press plate 215 is replaced onto the distal end of the press shaft 214.

To operate the wine press 201, the mode switch 220 is set to "run" mode. Thereafter, the user depresses the directional switch 219 to the "down" position causing the press plate 215 to move downwardly from its topmost position at a slow rate within the tank 204 to press down against the crushed grapes. As the crushed grapes are pressed, additional juice is extracted and will flow through the plurality of tank openings 206 and into the reservoir 203. The user can jog the press plate 215 downwardly by alternately switching the directional switch 219 between the "down" and "neutral" positions to control the rate of descent and to impart progressive pressure upon the crushed skins to squeeze additional juice therefrom in a controlled manner. Jogging the press plate 215 in this manner avoids spraying of juice during pressing to ensure that the reservoir 203 collects all of the juice and none goes to waste. The reservoir is provided with a spout 209 to enable juice to run from it into a suitable collection basin (not shown) when the reservoir 203 becomes filled. When, due to reactional forces from the crushed grape skins, the electric motor 212 is unable to drive the press plate 215 down any further, the electric motor 212 will detect this resistance in known ways through known circuitry and automatically shut off. Alternatively, the user can shut off the electric motor 212 by switching the directional switch 219 from the "down" position to the to the "neutral" position once a desired lower position has been reached. Once the press plate 215 stops downward movement and all juice has been extracted, the user may switch the directional switch 219 to the "up" position to return the press plate 215 to its top-most position outside of the tank 204. The remaining highly compressed solid mass of pressed grape skins which is almost dry and which occupies approximately the lower half of the tank 204 may then be removed and the interior of the tank 204 cleaned as previously described. Next, the user disengages the removable pin 246, removes the press plate 215, and adds another desired amount of crushed grapes to the tank 204 and starts the entire pressing process over again until a desired amount of juice is obtained.

Alternatively, the press 201 may be operated by utilizing preprogrammed buttons 218 during "run" mode. After crushed grapes are loaded within the tank 204, with the press plate 215 may be positioned at the starting position Height A by depressing the button 218 designated as 3. Thereafter, the user depresses the button 218 designated as 2, thereby moving the press plate 215 from Height A to Height B at a slow rate. In this manner, crushed grapes are pressed in a controlled manner that enables all extracted juice to flow through the plurality of tank openings 206 and into the reservoir 203. Once Height B is reached, the user may depress the button 218 designated as 1 thereby moving the press plate 215 from Height B to Height C. Additional juice is extracted from the crushed grapes which flows in a controlled manner into the reservoir 203. Once the press plate 215 stops at Height C, the user depresses the button 218 designated as 3 returning the press plate 215 to Height A for removal of the highly compressed solid mass of pressed grape skins and cleaning and previously described.

Without further elaboration the foregoing will so fully illustrate my invention that others may, by applying current or future knowledge, adopt the same for use under various conditions of service.

What is claimed:

1. A press for extracting juice from fruit comprising:

a. a reservoir having a base and a reservoir wall extending from said base and an element for draining juice from said reservoir, said base having a fruit-contacting side, a non-fruit-contacting side and an opening;

b. a tank having a first opened end, a second opened end and a sidewall disposed therebetween, said sidewall having a plurality of openings, said tank seated on said fruit-contacting side of said base;

c. an actuator module positioned on said non-fruit-contacting side of said reservoir base, said actuator module comprising a motor and a press shaft, said press shaft disposed through said opening of said reservoir base and extending into said tank, said motor drivingly connected to said press shaft to move said press shaft linearly within said opening between retracted and extended positions; and, d. a press plate detachably secured to said press shaft.

2. A press as recited in claim 1 wherein said press is positioned vertically.

3. The press of claim 1 wherein said press shaft is hollow, having an inner wall.

4. The press of claim 3 wherein a ball element is partially housed in said inner wall of said press shaft wherein fruit is pressed between said press plate and said fruit contacting side of said reservoir base.

5. The press of claim 4 wherein said actuator module further comprises a threaded rod, said press shaft being disposed over said threaded rod so as to engage said ball element with the threads of said threaded rod, creating a relationship whereby said ball element follows the helical contours of the threads of said threaded rod as said threaded rod rotates, thereby moving said press shaft linearly, between retracted and extended positions.

6. The press of claim 5 wherein said actuator module further comprises an actuator housing which encases said threaded rod and a portion of said press shaft that is not in said tank at any given instance.

7. The press as recited in claim 6 further comprising:

a. a variable resistance circuit, said circuit arranged to maintain a resistance value representative of a corresponding position of said press plate;

b. a processor including a comparator for determining said corresponding position of said press plate by measuring the resistance value of said circuit and being operative in response to receipt of an operator signal representative of a desired press plate position to energize said motor to move the press plate to a position corresponding to said desired position and operative in response to detecting a present position matching said desired position to de-energize said motor.

8. The press as recited in claim 7 wherein said variable resistance circuit comprises first and second linear conductor segments disposed on said actuator housing, said segments being oriented substantially parallel to each other, said variable resistance circuit further comprising a bridging conductor being in electrical contact with said segments to complete said circuit, the resistance of said circuit varying based upon the position of said bridging conductor between said conductor segments.

9. The press as recited in claim 8 wherein a first terminal is located at a first end of said first linear conductor segment and wherein a second terminal is located at a first end of said second linear conductor segment, said comparator being linked to said first and second terminals to obtain resistance characteristics of said variable resistance circuit.

10. The press as recited in claim 7 further comprising an operator input electrically connected to said motor, said operator input being arranged to generate an operator signal representative of a desired direction of linear movement of said press shaft.

11. The press as recited in claim 6 wherein said motor comprises an output shaft, wherein said output shaft comprises a worm gear and said threaded rod further comprises a worm wheel, whereby said worm gear is drivingly connected to said worm wheel, such that rotation of said output shaft causes said threaded rod to rotate.

12. The press of claim 3 wherein said actuator module further comprises a threaded rod, said press shaft being internally threaded and disposed over said threaded rod in threaded engagement therewith such that the rotation of said threaded rod causes said press shaft to move linearly between retracted and extended positions.

13. A press for the purpose of extracting juice from fruit comprising:

a. a reservoir having a base and a reservoir wall extending from said base and an element for draining juice from said reservoir, said base having a fruit-contacting side, a non-fruit-contacting side and an opening;

b. a tank having a first opened end and a second opened end, a sidewall disposed therebetween, said sidewall having a plurality of openings, said tank seated on the fruit-contacting side of said base;

c. a press plate; and, d. a means for pulling the press plate towards said fruit contacting side of said reservoir base for pressing fruit between said press plate and said fruit contacting side of said reservoir base, wherein said means for pulling the press plate is positioned on said non-fruit-contacting side of said reservoir base, said means for pulling the press plate disposed through said opening in said reservoir base and said means for pulling the press plate traveling linearly within said opening of said reservoir base.

* * * * *